US009580830B2

(12) United States Patent
Song

(10) Patent No.: US 9,580,830 B2
(45) Date of Patent: Feb. 28, 2017

(54) METHOD OF PREPARING A MAGNESIUM ALLOY SUBSTRATE FOR A SURFACE TREATMENT

(75) Inventor: Guangling Song, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1612 days.

(21) Appl. No.: 12/954,091

(22) Filed: Nov. 24, 2010

(65) Prior Publication Data

US 2012/0064251 A1 Mar. 15, 2012

Related U.S. Application Data

(60) Provisional application No. 61/381,647, filed on Sep. 10, 2010.

(51) Int. Cl.

| | |
|---|---|
| ***B05D 3/02*** | (2006.01) |
| ***C25D 13/20*** | (2006.01) |
| ***B05D 7/14*** | (2006.01) |

(52) U.S. Cl.

CPC ..... *C25D 13/20* (2013.01); *B05D 7/142* (2013.01); *B05D 2202/20* (2013.01); *B05D 2350/63* (2013.01)

(58) Field of Classification Search

USPC ..... 205/321; 427/372.2; 148/285; 428/421, 428/422, 469, 472

See application file for complete search history.

(56) References Cited

U.S. PATENT DOCUMENTS

| | | | | |
|---|---|---|---|---|
| 2,313,754 | A * | 3/1943 | Loose | 205/321 |
| 4,965,088 | A * | 10/1990 | Shimamune et al. | 427/2.27 |
| 5,264,113 | A * | 11/1993 | Bartak et al. | 205/321 |
| 5,401,442 | A * | 3/1995 | Miyata | 252/609 |
| 5,756,218 | A * | 5/1998 | Buchheit et al. | 428/469 |
| 6,328,530 | B1 * | 12/2001 | Kato et al. | 415/200 |

FOREIGN PATENT DOCUMENTS

| | | |
|---|---|---|
| CN | 1900360 A | 1/2007 |

* cited by examiner

*Primary Examiner* — Nathan T Leong
(74) *Attorney, Agent, or Firm* — Quinn Law Group

(57) ABSTRACT

A method of preparing a magnesium alloy substrate for an electroless electro-deposition surface treatment includes cleaning the magnesium alloy substrate in a wet solution, whereby a magnesium hydroxide layer is formed on an outer surface of the magnesium alloy substrate, and heating the magnesium alloy substrate to a temperature sufficient to convert the magnesium hydroxide layer to a magnesium oxide layer.

11 Claims, 1 Drawing Sheet

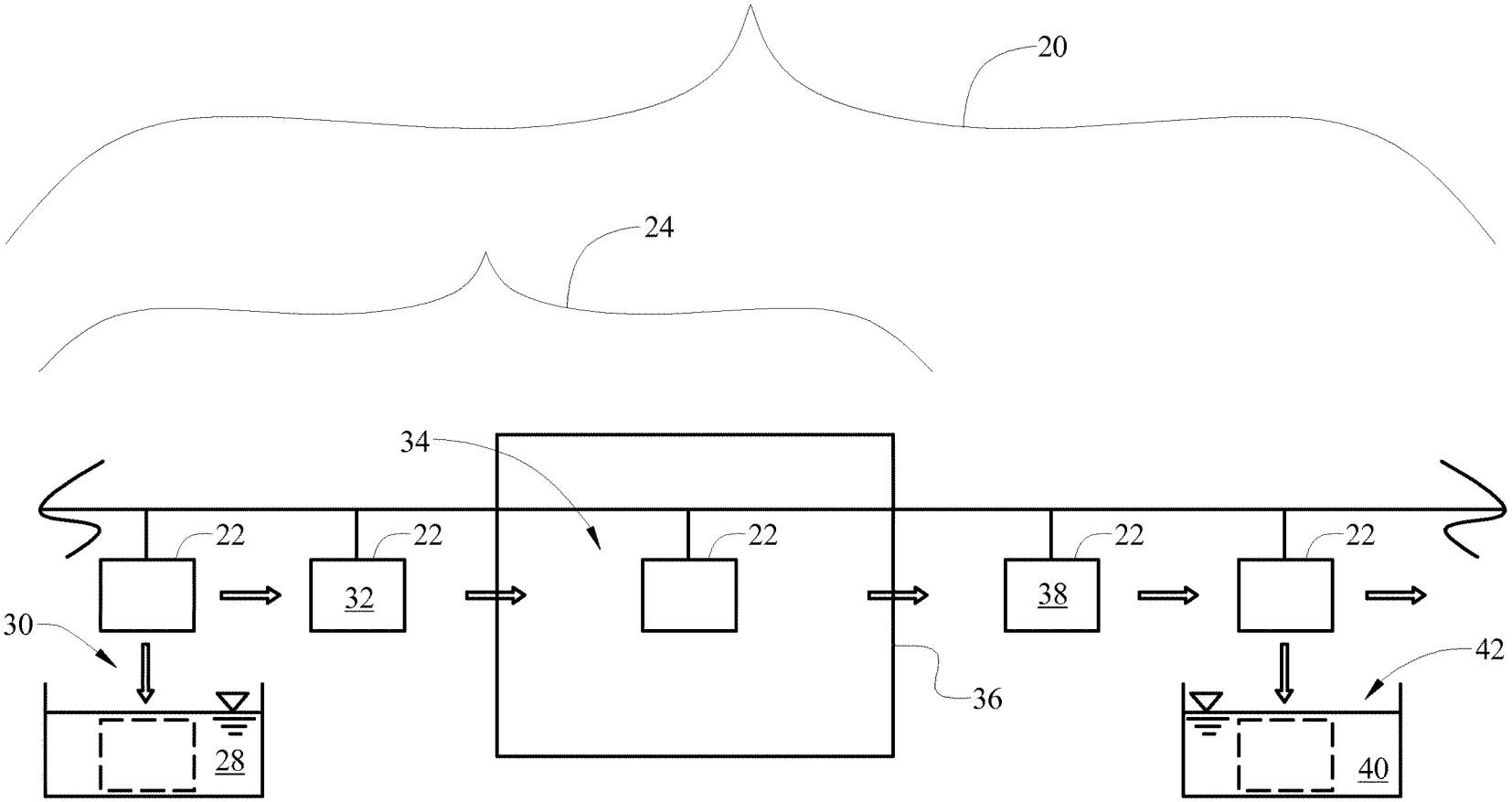
20
24
22
22
22
22
22
32
38
34
36
28
40
30
42

METHOD OF PREPARING A MAGNESIUM ALLOY SUBSTRATE FOR A SURFACE TREATMENT

CROSS-REFERENCE TO RELATED APPLICATIONS

This application claims the benefit if U.S. Provisional Patent Application Ser. No. 61/381,647, filed on Sep. 10, 2010, the disclosure of which is hereby incorporated by reference.

TECHNICAL FIELD

The invention generally relates to a method of applying a surface treatment to a magnesium alloy substrate, and more specifically to a method of preparing the magnesium alloy substrate for the surface treatment.

BACKGROUND

Metal substrates, including but not limited to various manufacture components and/or parts, are often treated with an electro-deposition coating prior to final finishing, e.g., painting. The substrate must be clean prior to application of the electro-deposition coating. Typically, and particularly in mass production, the substrate is cleaned in a wet cleaning process with a water based solvent, such as but not limited to an acid solvent or a base solvent. The substrate is allowed to dry and then submerged in a bath of the electro-deposition solution, whereupon an electrical charge is applied to the metal substrate, which attracts oppositely charged paint particles suspended in a water based solution. The electro-deposition coating process provides a protective film over the entire surface of the substrate.

An "electroless" electro-deposition coating process has been developed for coating a substrate manufactured from and/or including a magnesium alloy with the electro-deposition solution. The electroless coating process applies the electro-deposition solution to the magnesium alloy substrate without applying the electrical charge to the magnesium alloy substrate. Accordingly, the electroless coating process does not require an electrical charge. Rather, the electroless coating process submerges the substrate in the bath of the electro-deposition solution, or a solution similar to the electro-deposition solution, to apply the electro-deposition solution such that a layer of polymer containing materials are deposited onto the magnesium alloy substrate due to a surface alkalization effect.

The electroless coating process is less effective when applied to a magnesium alloy substrate having a magnesium hydroxide layer on the outer surface of the substrate. Because the reaction between the magnesium alloy substrate and the wet cleaning solution produces a magnesium hydroxide layer on the outer surface of the substrate, the magnesium alloy substrate may be "dry polished", i.e., cleaned in the absence of a water based solution, so as to form a magnesium oxide layer on the outer surface of the substrate instead of the magnesium hydroxide layer formed when using the wet cleaning solution. The electroless coating process is more effective when applied to a fresh magnesium alloy substrate without any surface films, or on a magnesium alloy substrate having a magnesium oxide layer on the outer surface of the substrate.

SUMMARY

A method of applying a surface treatment to a magnesium alloy substrate is provided. The method includes cleaning the magnesium alloy substrate with a wet solution, whereby a magnesium hydroxide layer is formed on the magnesium alloy substrate, heating the magnesium alloy substrate to transform the magnesium hydroxide layer into a magnesium oxide layer, and applying a coating of an electro-deposition solution to the magnesium alloy substrate in the absence of an electrical charge in either the magnesium alloy substrate and the electro-deposition solution.

A method of preparing a magnesium alloy substrate for a surface treatment is also provided. The method includes cleaning the magnesium alloy substrate with a wet solution, whereby a magnesium hydroxide layer is formed on the magnesium alloy substrate, and heating the magnesium alloy substrate to transform the magnesium hydroxide layer into a magnesium oxide layer.

Accordingly, the magnesium alloy substrate may be cleaned with a wet cleaning solution, which produces a magnesium hydroxide layer on an outer surface of the substrate. The wet cleaning process is more cost effective for mass production than is cleaning the magnesium alloy substrate with a dry-polishing process. The substrate is then heated to convert the magnesium hydroxide layer to a magnesium oxide layer, which then allows the surface of the magnesium alloy substrate to be treated with the electro-deposition coating through an electroless coating process, in which the electro-deposition solution is applied by simply submerging the magnesium alloy substrate in a bath of the electro-deposition solution in the absence of an electrical charge. The electroless coating process reduces the cost of applying the electro-deposition solution to the magnesium alloy substrate when compared to a traditional electro-deposition coating process which requires an electrical charge be applied to the magnesium alloy substrate.

The above features and advantages and other features and advantages of the present invention are readily apparent from the following detailed description of the best modes for carrying out the invention when taken in connection with the accompanying drawings.

BRIEF DESCRIPTION OF THE DRAWINGS

FIG. 1 is a schematic diagram of a surface preparation and treatment process for a magnesium alloy substrate.

DETAILED DESCRIPTION

Referring to FIG. 1, wherein like numerals indicate like parts throughout the several views, a method of applying a surface treatment to a substrate 22 is shown generally at 20. The substrate 22 is manufactured from and/or includes a magnesium alloy, and is hereinafter referred to as the magnesium alloy substrate 22. The surface treatment may include, but is not limited to, an "electroless" electro-deposition coating process, described in greater detail below.

The method 20 of applying the surface treatment includes a method 24 of preparing the magnesium alloy substrate 22 for the surface treatment. The method 24 of preparing the magnesium alloy substrate 22 includes cleaning the magnesium alloy substrate 22. The magnesium alloy substrate 22 is cleaned through a wet cleaning process with a wet cleaning solution 28. The wet cleaning solution 28 may include, but is not limited to an acidic water based cleaning solution, a basic water based cleaning solution, or a combination of acidic and basic water based cleaning solutions, wherein the acidic and basic cleaning solutions may be applied in any order relative to each other. The wet cleaning process may include, but is not limited to, submerging the magnesium alloy substrate 22, generally indicated at 30, in a bath of the wet cleaning solution 28 to dissolve and/or otherwise remove dirt, debris and/or grease from the magnesium alloy substrate 22. It should be appreciated that the wet cleaning solution 28 may be applied, and the magnesium alloy substrate 22 cleaned, in some other manner not shown or described herein. Because the wet cleaning solution 28 is water based, a magnesium hydroxide layer 32 is formed on an outer surface of the magnesium alloy substrate 22 during the wet cleaning process. The magnesium hydroxide layer 32 prevents effective bonding and/or coating of the electro-deposition solution 40 onto the magnesium alloy substrate 22 through the electroless coating process.

Once the magnesium alloy substrate 22 is removed from the bath of the wet cleaning solution 28, the method 24 of preparing the magnesium alloy substrate 22 for the surface treatment further includes heating the magnesium alloy substrate 22, shown generally at 34, after the magnesium alloy substrate 22 is cleaned with the wet cleaning solution 28. The magnesium alloy substrate 22 may be heated in an oven 36 to a temperature sufficient to transform the magnesium hydroxide layer 32 into a magnesium oxide layer 38. The magnesium oxide layer 38 allows for effective bonding and/or coating of the electro-deposition solution 40 onto the magnesium alloy substrate 22 through the electroless coating process.

The magnesium alloy substrate 22 is heated to a temperature of at least two hundred degrees Celsius (200° C.), and more preferably to a temperature of at least at least three hundred fifty degrees Celsius (350° C.). Additionally, the magnesium alloy substrate 22 is heated for a duration of time equal to at least twenty minutes (20 min), and more preferably for a duration of time equal to at least forty minutes (40 min). Heating the magnesium alloy substrate 22, and more particularly the magnesium hydroxide layer 32 on the outer surface of the magnesium alloy substrate 22 at such high temperatures for sufficient time allows the magnesium hydroxide layer 32 to react, and thereby form the magnesium oxide layer 38, which is more conducive for the electroless electro-deposition coating process. Accordingly, once the magnesium alloy substrate 22 has been heated, and the magnesium hydroxide layer 32 reacted to form the magnesium oxide layer 38 on the outer surface of the magnesium alloy substrate 22, the magnesium alloy substrate 22 is prepared and ready for the surface treatment.

In order to improve manufacturing efficiency, it is contemplated that the heating 34 of the magnesium alloy substrate 22 to dry the wet cleaning solution 28 and transform the magnesium hydroxide layer 32 on the outer surface of the magnesium alloy substrate 22 to the magnesium oxide layer 38 may be combined with a heat treating process for the magnesium alloy substrate 22. As various heat treating processes include heating an article to specific temperatures for specific times to achieve pre-determined metallurgical characteristics, the temperature and time that the magnesium alloy substrate 22 is heated 34 to transform the magnesium hydroxide layer 32 to the magnesium oxide layer 38 may be dependent upon the specific heat treating process contemplated.

The method 20 of applying the surface treatment includes applying a coating of an electro-deposition solution 40 to the magnesium alloy substrate 22 through the electroless electro-deposition coating process. The electroless electro-deposition coating process includes submerging the magnesium alloy substrate 22, generally indicated at 42, in a bath of the electro-deposition solution 40 or some other similar solution capable of depositing polymers on the surface of the magnesium alloy substrate 22 due to a surface alkalization effect of the magnesium in the absence of an applied electrical charge to either the magnesium alloy substrate 22 and/or the electro-deposition solution 40. A standard electro-deposition coating process includes applying an electrical potential to the article to be coated to attract oppositely charged particles of the electro-deposition solution 40. However, the electroless electro-deposition coating process does not apply an electrical potential to the article, e.g., the magnesium alloy substrate 22, but instead allows a thin film of the electro-deposition solution 40 to form on the magnesium alloy substrate 22 naturally to fully coat the magnesium alloy substrate 22, without the applied electrical potential.

The electro-deposition solution 40 may include, but is not limited to, any commonly used and commercially available electro-deposition solution 40 that is used in a standard electro-deposition coating process, in which an electrical potential is applied to attract the electro-deposition solution 40 to the article. Additionally, the electro-deposition solution 40 may include any solution capable of depositing polymers onto the surface of the magnesium alloy substrate 22 due to the surface alkalization effect of the magnesium alloy.

While the best modes for carrying out the invention have been described in detail, those familiar with the art to which this invention relates will recognize various alternative designs and embodiments for practicing the invention within the scope of the appended claims.

The invention claimed is:

1. A method of applying a surface treatment to a magnesium alloy substrate, the method comprising:

cleaning the magnesium alloy substrate with a wet solution, whereby a magnesium hydroxide layer is formed on the magnesium alloy substrate;

heating the magnesium alloy substrate to a temperature of at least two hundred degrees Celsius (200° C.) to transform the magnesium hydroxide layer into a magnesium oxide layer; and applying a coating of an electro-deposition solution to the magnesium alloy substrate in the absence of an applied electrical charge in both the magnesium alloy substrate and the electro-deposition solution.

2. A method as set forth in claim 1 wherein cleaning the magnesium alloy substrate with a wet solution is further defined as cleaning the magnesium alloy substrate with an acidic water based cleaning solution.

3. A method as set forth in claim 1 wherein cleaning the magnesium alloy substrate with a wet solution is further defined as cleaning the magnesium alloy substrate with a basic water based cleaning solution.

4. A method as set forth in claim 1 wherein cleaning the magnesium alloy substrate with a wet solution includes submerging the magnesium alloy substrate in a bath of the wet solution.

5. A method as set forth in claim 1 wherein heating the magnesium alloy substrate to transform the magnesium hydroxide layer into the magnesium oxide layer includes heating the magnesium alloy substrate to a temperature of at least three hundred fifty degrees Celsius (350° C.).

6. A method as set forth in claim 1 wherein applying a coating of an electro-deposition solution to the magnesium alloy substrate in the absence of an applied electrical charge in both the magnesium alloy substrate and the electro-deposition solution includes submerging the magnesium alloy substrate in a bath of the electro-deposition solution to fully coat the magnesium alloy substrate.

7. A method of preparing a magnesium alloy substrate for a surface treatment, the method comprising:

cleaning the magnesium alloy substrate with a wet solution, whereby a magnesium hydroxide layer is formed on the magnesium alloy substrate; and heating the magnesium alloy substrate to a temperature of at least two hundred degrees Celsius (200° C.) to transform the magnesium hydroxide layer into a magnesium oxide layer.

8. A method as set forth in claim 7 wherein cleaning the magnesium alloy substrate with a wet solution is further defined as cleaning the magnesium alloy substrate with an acidic water based cleaning solution.

9. A method as set forth in claim 7 wherein cleaning the magnesium alloy substrate with a wet solution is further defined as cleaning the magnesium alloy substrate with a basic water based cleaning solution.

10. A method as set forth in claim 7 wherein cleaning the magnesium alloy substrate with a wet solution includes submerging the magnesium alloy substrate in a bath of the wet solution.

11. A method as set forth in claim 7 wherein heating the magnesium alloy substrate to transform the magnesium hydroxide layer into the magnesium oxide layer includes heating the magnesium alloy substrate to a temperature of at least three hundred fifty degrees Celsius (350° C.).

* * * * *